United States Patent [19]

Murahashi et al.

[11] Patent Number: 4,920,700

[45] Date of Patent: May 1, 1990

[54] PROCESS FOR FINISHING OPTICAL LENSES AND APPARATUS THEREFOR

[75] Inventors: Hiroyuki Murahashi, Tokyo; Yukio Akutsu, Ohme; Shinichi Koyama, Higashi-kurume, all of Japan

[73] Assignee: Hoya Corporation, Tokyo, Japan

[21] Appl. No.: 187,456

[22] Filed: Apr. 28, 1988

[30] Foreign Application Priority Data

Apr. 30, 1987 [JP] Japan ..... 62-107332

[51] Int. Cl.[5] ..... B24B 7/00

[52] U.S. Cl. ..... 51/124 L; 51/266

[58] Field of Search ..... 51/284 R, 326, 263, 51/266, 106 LG, 119, 123 R, 124 L, 133, 318, 425

[56] References Cited

U.S. PATENT DOCUMENTS 3,638,366 2/1972 Gamache ..... 51/263
3,782,045 1/1974 Kanda ..... 51/124 L
4,197,678 4/1980 Roll et al. ..... 51/267
4,733,502 3/1988 Braun ..... 51/284 R

FOREIGN PATENT DOCUMENTS 0021491 2/1978 Japan ..... 51/124 L

*Primary Examiner*—Frederick R. Schmidt
*Attorney, Agent, or Firm*—Nixon & Vanderhye

[57] ABSTRACT

A process and apparatus for finishing optical lenses including processing steps of smoothing and polishing of the lens, suitable in particular for the production of ophthalmic lenses, characterized by a special feature of replacing, after completion of the smoothing, the smoothing pad by a polishing and changing over the spent lapping compound recovering and recirculating means from that for the smoothing compound to that designated for a polishing compound, in order to effect thereafter the polishing of the lens on the same processing machine.

15 Claims, 4 Drawing Sheets

PROCESS FOR FINISHING OPTICAL LENSES AND APPARATUS THEREFOR

BACKGROUND OF THE INVENTION

1. Field of the Invention

The present invntion relates to a process for finishing optical lenses including processing steps of smoothing and polishing the lens, which is suitable in particular for the production of ophthalmic lenses, as well as to an apparatus for effecting such process.

2. Description of the Prior Art

In the production of optical glass lenses, especially of ophthalmic glass lenses, it has generally been practiced to process in such a manner, that a casted lens is first roughly ground using an abrasive and then subjected to a smoothing and a polishing to attain a contemplated optical surface of the lens in a sufficient accuracy. In the process steps of smoothing and polishing performed both in a similar manner as in the lapping, the lens held on a lens holder is placed on a finishing tool or lapping plate and the processing of lens surface is carried out by effecting a relative sliding movement of the lens and the finishing tool while supplying a lapping compound onto the lens. By the smoothing, the surface roughness of the lens is reduced and, by the polishing, the lens is finished in a sufficient accuracy into a smooth contemplated optical surface.

On the other hand, there have been brought into practical use plastic lenses produced by injection molding or casting in a mold. The surface of these plastic lenses produced in such techniques exhibits a sufficient optical accuracy, so that a finishing as in the case of glass lens can in general be dispensed with. In the practice, a plurality of standard models of molded plastic lenses having different diopters are provided, among which the user can select one suitable to him. Also in some cases of special optical prescriptions, a lens of special optical parameters different from those of the standard ones may be required. For preparing such a special lens, a molded lens having a thickness somewhat larger than that of the finished lens is employed and processed by smoothing and polishing, as in the case of glass lens.

The construction is the same for both the apparatuses for the smoothing and for the polishing and both include a conduit means for feeding processing compound and an arrangement for performing relative sliding motion of the finishing tool and the lens. Various arrangements for realizing such a relative sliding motion have been known, such as for example, the so-called UDAGAWA-arrangement, in which a triangular motion of the lens is incorporated with a rotating motion of the finishing tool, and the so-called AO-arrangement, in which a circular movement of the lens is combined with a rotary motion of the finishing tool. The finishing tool consists generally of a dish-like body having thereon a pad fixed with adhasive. The material of the dish and the type of the pad can adequately be chosen depending on the degree of finishing etc.

In the prior art practice, it is necessary to employ different processing tools and different lapping compounds for the smoothing and for the polishing, since the contemplated degree of surface finish is different for the smoothing and for the polishing. Thus, for the smoothing, a pad or a diamond or ceramic tool and a lapping compound both designated specifically therefor should be used and, for the polishing also, specifically designed ones are necessary. For this reason, two processing machines for the smoothing and for the polishing have hitherto been employed, which has resulted in not only a forced expense for the investment costs for the installations but also laborious works for the trasference of the lens from the smoothing machine to the polishing machine together with works for mounting and dismounting of the lens after the smoothing. A further dificulty may accompany by the circumstances that it is difficult to maintain the processing conditions for the smoothing and for the polishing due to the unavoidable errors or discrepancies in the dimension and in the motion between the smoothing and the polishing, which will often bring about processing errors. This problem is quite significant in the production of optical lenses, in particular, ophthalmic lenses requiring high optical accuracy.

BRIEF SUMMARY OF THE INVENTION

By the present invention, it is contemplated to remove the above difficulties.

An object of the present invention is to provide a process and an apparatus for finishing optical lenses in a high processing accuracy, in which the above dimensional errors and motional errors brought about by the transference of the lens to the separate processing machine.

Another object of the present invention is to propose a process and an apparatus for finishing optical lenses with high working efficiency by simplifying the processing works and reducing the number of work steps as scarce as possible by omitting lens transference procedure, mounting and dismounting of the lens and so on during the lens processing.

DETAILED DESCRIPTION OF THE INVENTION

The above objects are attained according to the present invention by a process for finishing optical lenses, which comprises subjecting the lens to be finished to a smoothing processing, while feeding onto the smoothing pad fixed on a dish-like tool and onto the lens a lapping compound for smoothing and while effecting a relative sliding motion of the lens and the pad fixed on said tool with simultaneous recovery and recirculation of the spent compound, replacing, after completion of the smoothing, the smoothing pad by a polishing pad and changing over the spent compound recovering and recirculating means from that for the smoothing compound to that designated for a polishing compound and performing then the polishing while feeding the polishing compound onto the polishing pad and onto the lens and while effecting a relative sliding motion of the lens and the pad fixed on said tool.

For realizing the above process, an apparatus is proposed by the present invention, which comprises an arrangement for effecting relative slide motion of the lens to be finished and the pad fixed on a dish-like tool; a means for feeding a lapping compound for smoothing or polishing onto the lens and onto the pad; a means designed to effect recovery and recirculation of the spent compound separately for the smoothing compound and for the polishing compound; and a means for changing over the spent compound recovering and recirculating means from that designated for the smoothing compound to that for the polishing compound and vice versa.

BRIEF DESCRIPTION OF THE DRAWINGS APPENDED

DETAILED DESCRIPTION OF PREFERRED EMBODIMENTS

Below, the present invention will further be described in more detail by way of examples with reference to the Drawings appended.

Figure 1:
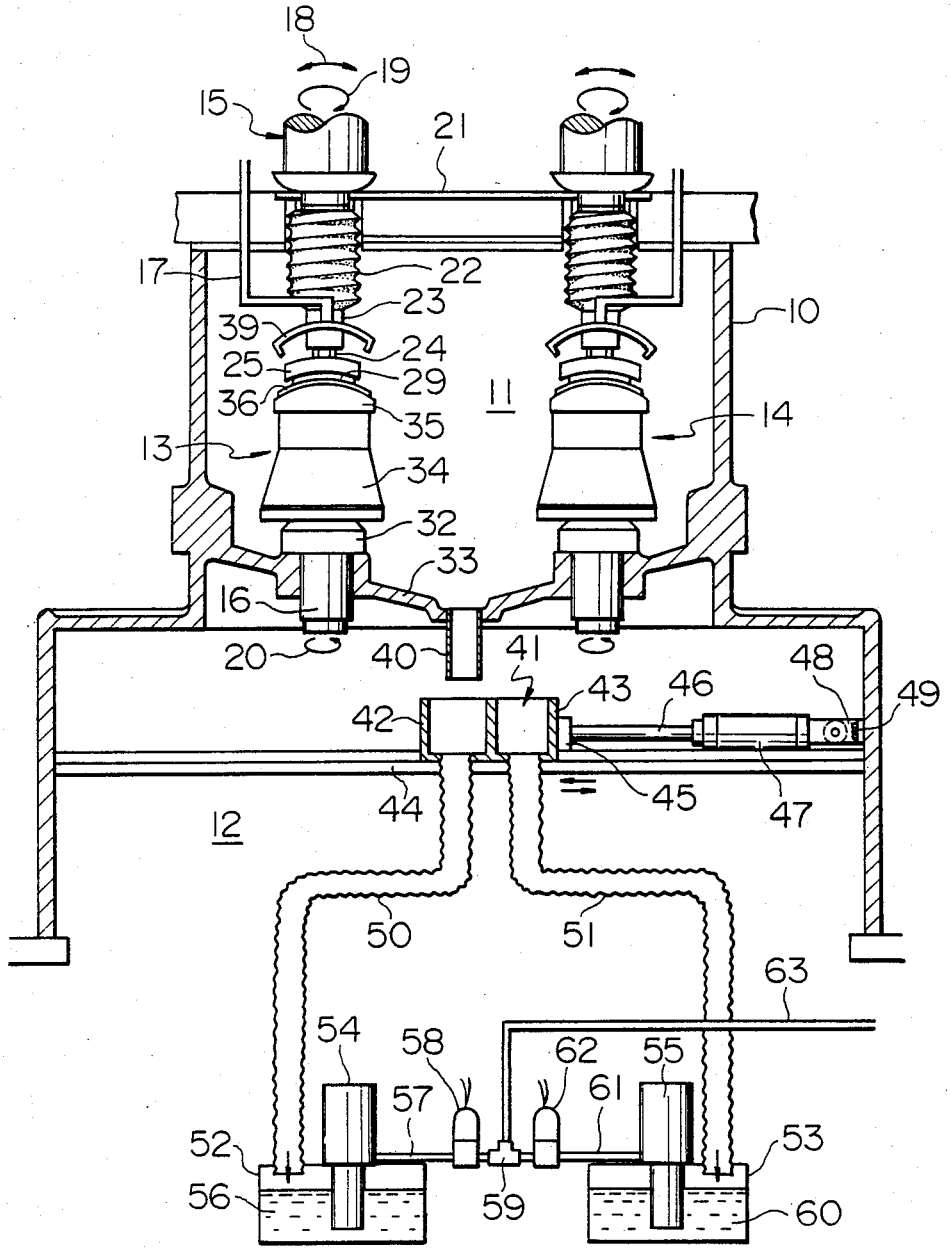
FIG. 1 shows an embodiment of the apparatus according to the present invention in a schematic vertical sectional illustration.

A first embodiment of the apparatus according to the present invention as shown in FIG. 1 is composed of a processing chamber 11 and of a spent lapping compound recirculation chamber 12 surrounded by a housing 10. In a front portion of the housing 10, there is provided a door means (not shown) for use for mounting and dismounting the lenses and the processing pads. In the processing chamber 11, two processing units 13 and 14 are disposed for permitting the smoothing or polishing of two lenses simultaneously. Since the structure of these processing units 13, 14 is the same, explanations are directed hereinafter only to the processing unit 13.

The processing unit has an upper shaft 15 and a lower shaft 16 and is furnished with a supply line 17 for supplying the lapping compound. The upper shaft 15 performs a swinging motion as suggested by the arrow 18 and a simultaneous rotating motion around the central axis of the shaft as indicated by the arrow 19, by means of a not shown driving unit. The lower shaft 16 rotates around its central axis as suggested by the arrow 20, by a not shown driving unit.

Various alternatives for the manner and arrangement for effecting the motions of the upper and lower shafts 15 and 16 have been known in the stand of the technique, among which one suitable for each specific case can be chosen in accordance with the type of lens to be finished, requisite degree of surface finish and so on.

Figure 2:
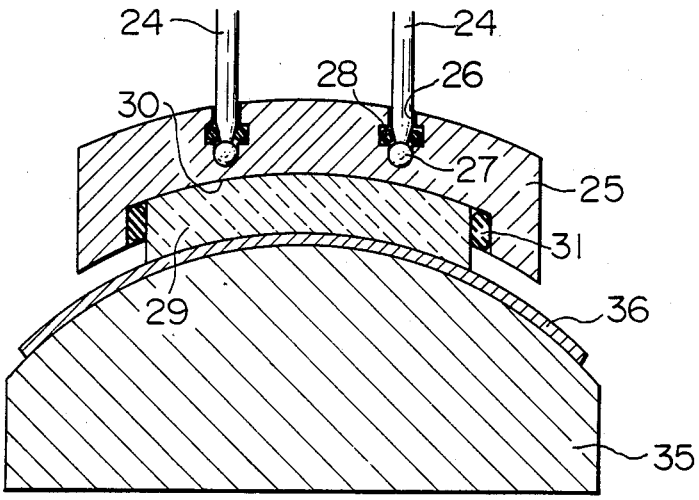
FIG. 2 shows the portion around the lens of FIG. 1 in an enlarged vertical section showing the condition of the lens during processing.

The upper shaft 15 is supported on a cross beam 21 fixed on the housing 10 and is connected to a spindle 23 through a pneumatic actuation cylinder accomodated within a bellows-like extensible muff 22. The pneumatic actuation cylinder can be operated by a foot switch disposed on the floor of the processing machine with adjustment of the force of pressing of the lens onto the pad by adjusting the pneumatic pressure. Beneath the spindle 23, two supporting rods 24 are fixed. By inserting these rods into each corresponding holes 26 disposed on the lens holder 25 as illustrate in FIG. 2, the lens holder can be held can be held fixed by a snap fit. Thus, as shown in FIG. 2, the terminal ball 27 at the end of the rod 24 is pressed into the receptacle indentation through a rubber O-ring 28 under a forced deformation thereof upon insertion of the rod into the hole 26 to thereby cause a snap fit.

The lens holder 25 is provided on its underside face with a concave recess 30 for receiving the lens 29 to be finished. Around the receptacle recess 30 is fitted an annular fitting rubber 31, which serves for snugly holding the lens 29 by a resilient deformation of the rubber upon insertion of the lens into the recess 30 by pressing it.

Figure 3:
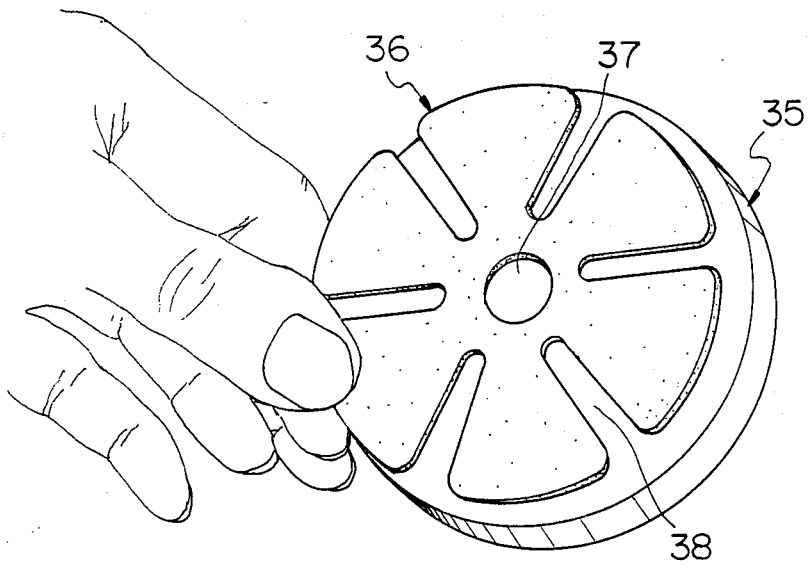
FIG. 3 illustrates the condition as to how the pad is fitted to the lens, in a perspective view.

The lower shaft 16 is supported rotatably on the bottom 33 of the processing chamber 11 via a bearing frange 32 and can be rotated to the direction indicated by the arrow 20 by a not shown driving unit. A mount 34, on which a finishing tool or finishing dish 35 is removably mounted, is fixedly arranged on the lower shaft 16. The lower shaft 16, the finishing dish mount 34 and the finishing dish 35 are integrally driven for rotation. The upper face of the finishing dish 35 is shaped into a surface of a definite curvature corresponding to that of the finished lens. On the finishing dish 35 is fittedly mounted a processing pad 36. As the processing pad 36 for the smoothing, a pad prepared by, for example, laminating on a heat resistant resin sheet a sintered aluminum oxide layer to be served for the processing face is employed. For the polishing, a pad made of polyurethane sheet or felt sheet is used. The pad 36 is fixed on the finishing dish 35 using an adhesive applied on the rear face of the pad. The pad 36 is provided, as shown in FIG. 3, with a central hole 37 and six radially cut-off portions 38 for facilitating uniform distribution of lapping compound over the entire surface of the lens.

The supply line 17 provided on the processing unit 13 is branched at its end portion 39 into a plurality of discharge nozzles to permit spraying of the lapping compound onto the lens 29 and onto the pad 36. For the lapping compound, various materials can be used. For example, in processing glass lens, there are used so-called diamond pellets, which are prepared by sintering fine particles of diamond using a binder of metal or resin; boron carbide; silicon carbide; aluminum oxide and liquid wax etc. for the smoothing and, for the polishing, an aqueous slurry of cerium oxide, chromium oxide, iron oxide etc. In processing plastic lens, usually water is used in the smoothing and an aqueous slurry of cerium oxide is employed in the polishing.

The lapping compound sprayed will then flow down to the bottom 33 converging down to the center thereof and is discharged from an exit tube 40 arranged at the bottom center. Beneath the exit tube 40, a means for recovering and recirculating the lapping compound is provided. The means for recovering and recirculating the lapping compound has a receiver 41 with its upper face freely opening beneath said exit tube 40 for receiving the lapping compound discharged. The compound receiver 41 is partitioned into two distinct sections 42 and 43 for receiving the lapping compound for smoothing and the lapping compound for polishing respectively in a separate manner. The receiver 41 is arranged slidably along a rail 44 disposed across the housing 10. The sliding of the compound receiver 41 is realized by an actuator consisting of combination of a piston rod 46 connected to the receiver 41 and a pneumatic cylinder 47 fixed to the housing 10 by a junction member 48 and a fixing bolt 49. On actuating the cylinder 47, the compound receiver 41 is slid along the rail 44 and is settled at either of the two predetermined positions where the section 42 of the receiver 41 is found directly beneath the exit tube 40 for receiving the lapping compound, on the one hand, or the section 43 of the receiver 41 is found directly beneath the exit tube 40 for receiving the lapping compound, on the other hand. The actuation of the pneumatic cylinder 47 is controlled by a control unit having a CPU. It is possible to dispose a filter on the bottom of each section 42, 43 of the receiver 41 in order to remove the particles ground off from the lens or other foreign matters.

To each section 42, 43 of the compound receiver is connected a flexible bellows-like pipe 50, 51 which communacates either to a smoothing compound reservoir 52 or to a polishing compound reservoir 53. Each of the compound reservoirs 52, 53 is provided with a feed pump 54 or 55. The smoothing compound 56 is recirculated by the feed pump 54 to the supply line 17 through a conduit 57, a magnetic valve 58, a T-joint 59 and a lapping compound return line 63. On the other hand, the polishing compound 60 is recirculated by the feed pump 55 also to the supply line 17 through a conduit 61, magnetic valve 62, the T-joint 59 and the return line 63. The actuation of the magnetic valves 54 and 55 is controlled by a sequense circuit of a controll unit in such a manner, that either of the two valves will be opened when the other one is closed, so that no mixing of the lapping compound 56 for smoothing with the lapping compound 60 for polishing will occur.

Below, the manner of finishing of lens by the apparatus according to the invention constructed as above will be described.

The starting lens 29 to be processed, namely, a casted or rough ground glass lens or a molded plastic lens, is mounted on the lens holder 25 by inserting it into the receptacle recess 30 of the lens holder. Then, the supporting rods 24 are inserted into the corresponding holes 26 of the lens holder 25 to fix the lens holder 25 on the spindle 23. Thereafter, the smoothing pad 36 is placed on the finishing dish 35. On manipulating a switch button for the smoothing operation, the pneumatic cylinder 47 is actuated, whereby the section 42 of the compound receiver 41 is moved to the position directly beneath the exit tube 40, as shown in FIG. 1. The feed pump 54 and the magnetic valve 58 are then actuated, whereby the lapping compound 56 for smoothing, such as liquid wax or water, is pumped through the T-joint 59, return line 63, supply line 17 and the branched portion 39 thereof and fed onto the lens 29 and onto the pad 36.

By operating the foot switch, the pneumatic cylinder inside the muff 22 is actuated, whereby the spindle 23, the supporting rods 24, the lens holder 25 and the lens 29 are caused to descend to thereby press the lens 29 onto the pad 36. Now the upper shaft 15 and the lower shaft 16 are brought into the motion of swinging and rotation as well as of rotation respectively in the direction suggested by the arrows 18, 19 and 20 respectively using a not shown driving unit, whereby the smoothing of the lens is realized. During the smoothing, the lapping compound supplied onto the pad 36 and lens 29 flows down continuously to the bottom 33 of the processing chamber 11 and is collected into the exit tube 40, from which it is recovered through the section 42 of the receiver 41 and the pipe 50 into the lapping compound reservoir 52 and then is recirculated again to the supply line 17 via valve 54, conduit 57, T-joint 59 and return line 63, as explained previously.

The duration of smoothing is controlled by a control nuit in such a manner, that the smoothing will be terminated by stopping the driving of upper and lower shafts 15, 16 after a predetermined time interval, for example, 1–2 minutes. Briefly before the termination of the driving of the shafts 15 and 16, namely before about 10 seconds, the feed pump 54 is stopped by the action of the sequence circuit in the control unit. Thus, the supply of the smoothing compound 56 is stopped and the portion of the compound supplied already to the processing units is recovered thereafter into the reservoir 52.

When the driving of the upper and lower shafts 15 and 16 is stopped, the pneumatic cylinder 47 is actuated by the sequense circuit of the control unit, whereby the section 43 of the receiver 41 is moved to the position directly beneath the exit tube 40 and, at the same time, the magnetic valve 54 is closed and the magnetic valve 63 is opened.

Then, the polishing is realized as follows: The foot switch is made "on". The pneumatic cylinder in the muff 22 is actuated, whereby the spindle 23, supporting rods 24, lens holder 25 and the lens 29 are moved upwards. Subsequently, the not shown door means on the housing 10 is opened in order to remove the smoothing pad mounted on the finishing dish 35 and to replace it by the polishing pad. Then, the feed pump 55 and the magnetic valve 62 are brought into operation to supply the lapping compound 56 for polishing, such as an aqueous slurry of cerium oxide, onto the pad 36 and the lens 29 through the T-joint 59, the return line 63 and the supply line 17, as in the smoothing operation. By actuating the foot switch, the pneumatic cylinder in the muff 22 is actuated again so as to press the lens onto the pad 36 by moving downwards the spindle 23, supporting rods 24, lens holder 25 and lens 29. In this condition, the polishing is effected under incorporation of swinging and rotation of the upper shaft 15 and rotation of the lower shaft 16 simultaneously as indicated by the arrows 18, 19 and 20. During the polishing, the polishing compound fed to the pad and lens flows successively down to the bottom 30 of the processing chamber 11 and is collected to the exit tube 40, from which it is recovered into the polishing compound reservoir 53 through the receiver section 43 and the pipe 51.

The polishing is effected for a definite time interval, for example 1–2 minutes. Briefly before the completion of the polishing, e.g. about 10–15 seconds before the completion, supply of the lapping compound is stopped and the recovery of the compound is further continued for the already fed compound, as in the case of the smoothing.

As explained above, it is now made possible according to the present invention, to realize the smoothing and the polishing of lens on one and the same processing machine by only changing over the lapping compound to be fed to the processing unit and replacing the processing pad 36.

Figure 4:
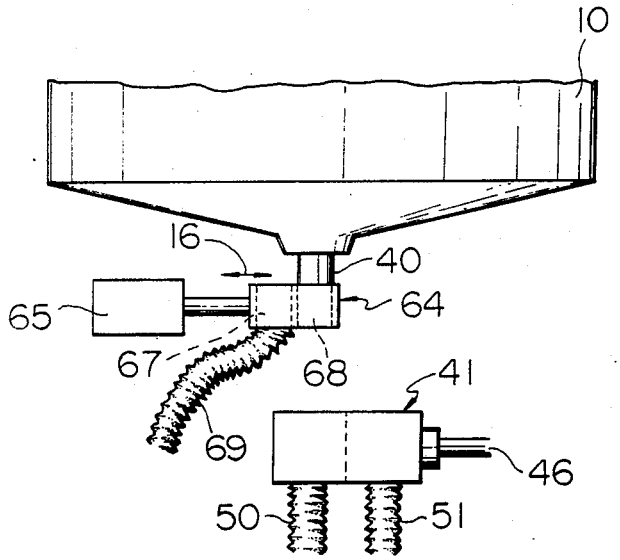
FIG. 4 shows an alternative embodiment of the means for changing over the spent lapping compound, in a front view.

It is to be noted that the present invention should be no means be restricted only to the above described specific embodiments. Thus, it is of course possible to incorporate water wash of the machine inside by supplying water from the supply line 17, in order to prevent mixing of the smoothing compound 56 with the polishing compound 60 upon change-over of the processing mode. For this, a change-over valve 64 is disposed at the exit tube 40, as shown in FIG. 4, which is operated by a pneumatic cylinder or an electromagnetic actuator means 65 to put into or get aside, as suggested by the arrow 66. The change-over valve 64 has two change-over joints or openings 67 and 68. The change-over joint 67 communicates to a drain line 69 to permit exhaustion of the wash water. The change-over joint 68 will be positioned directly above the receiver 41 when it is connected to the exit tube 40. The lapping compound supply line 17 is connected to a washing water supply line upon the water wash.

The present invention proposes advantageous effects as follows:

By exchanging the finishing pad and changing over the lapping compound, the smoothing and the polishing of lens can be realized on one and the same processing machine, resulting thus in a reduction of manufacturing costs together with an increase in the dimensional accuracy of the finished lens due to elimination of the trasference of lens from one machine to another as in the prior technique. It is also possible to increase the efficiency of the finishing, since mounting and dismounting of lens during the processing is eliminated.

The process and the apparatus according to claims 2 and 3 can offer a reliable prevention of mixing of the smoothing compound with the polishing compound upon change-over of the processing mode.

What is claimed is:

1. An apparatus for finishing optical lenses comprising:

a housing enclosing at least one lens processing chamber;

at least one processing unit within said chamber, said processing unit including a lens holder adapted to receive and hold an optical lens thereon, and a finishing tool mounted for operative engagement with the optical lens held by said lens holder, said finishing tool comprising one or the other of a smoothing pad and a polishing pad;

means for moving said lens holder toward and away from said finishing tool;

feeding means for feeding one of a smoothing compound and a polishing compound onto said lens and said finishing tool;

exit tube means associated with said chamber for discharging said one of said smoothing compound and polishing compound;

first and second receiver means for separately receiving spent smoothing compound and spent polishing compound from said exit tube means;

drive means for moving one of said first and second receiver means into operative association with said exit tube means; and recirculation means connected to said feeding means and to said first and second receiver means for recirculating one of said spent smoothing compound and said spent polishing compound from said first and second receiver means to said feeding means.

2. An apparatus according to claim 1, which further comprises a means for injecting water into the lens processing chamber to effect water wash of the at least one processing unit, a means for effecting discharge of the wash water and spent compound from said exit tube, and a means for changing over said means for effecting discharge of the wash water to either one of the first and second receiver means.

3. Apparatus as defined in claim 1 wherein said lens holder is mounted on a first upper shaft, and wherein said lens holder is mounted for rotation and swinging movement about an axis of said shaft.

4. Apparatus as defined in claim 3 and wherein said finishing tool is mounted for rotation on a second, lower shaft.

5. Apparatus as defined in claim 1 and wherein said lens holder is formed with a recess on an undersurface thereof, said recess fitted with an annular, resilient member for holding the lens within said recess.

6. Apparatus as defined in claim 4 wherein said finishing tool includes a mounting member fixed to said shaft, said mounting member supporting a dish having a curved upper face for supporting one or the other of said smoothing and polishing pads.

7. Apparatus as defined in claim 6 and wherein said curved surface corresponds to that of a finished lens.

8. Apparatus as defined in claim 6 wherein one of said smoothing pad and said polishing pad is mounted to said dish by adhesive means.

9. Apparatus as defined in claim 1 wherein a pair of processing units are located within said chamber.

10. Apparatus as defined in claim 1 and wherein said first and second receiver means are selectively movable to a position directly beneath said exit tube by hydraulic means, and wherein a control circuit is provided to actuate said compound feeding means in response to movement of said first and second receiver means.

11. An apparatus as defined in claim 1, wherein said recirculation means comprises first and second reservoirs receiving therein respectively said spent smoothing compound and said spent polishing compound, pipe means through which said first and second receiver means are connected respectively to said first and second reservoirs, first conduit means through which said first reservoir is connected to said feeding means, second conduit means through which said second reservoir is connected to said feeding means, and first and second valve means provided respectively in said first and second conduit means, wherein said first and second valve means are such that, when said first valve means is closed, said second valve means is open, and when said second valve means is closed, said first valve is open.

12. An apparatus as defined in claim 11, wherein said pipe means comprises first and second pipes through which said first and second receiver means are connected respectively to said first and second reservoirs.

13. An apparatus as defined in claim 1, wherein said first and second receiver means are formed respectively by first and second receiver sections which are united together, and wherein said drive means moves said first and second receiver sections horizontally.

14. An apparatus as defined in claim 1, wherein said first and second receiver means are formed respectively by first and second openings which are united together, and wherein said drive means is formed by actuator means which moves said first and second openings horizontally.

15. An apparatus as defined in claim 14, wherein said recirculation means comprises first and second reservoirs receiving therein respectively said spent smoothing compound and said spent polishing compound, pipe means through which said first and second receiver means are connected respectively to said first and second reservoirs, first conduit means through which said first reservoir is connected to said feeding means, second conduit means through which said second reservoir is connected to said feeding means, and first and second valve means provided respectively in said first and second conduit means, wherein said first and second valve means are such that, when said first valve means is closed, said second valve means is open, and when said second valve means is closed, said first valve means is open.

* * * * *